US008042845B2

(12) United States Patent
Tanimoto et al.

(10) Patent No.: US 8,042,845 B2
(45) Date of Patent: Oct. 25, 2011

(54) VEHICLE DOOR HANDLE

(75) Inventors: Tetsurou Tanimoto, Anjo (JP); Koichi Nagata, Chiryu (JP); Sadayuki Makino, Nagoya (JP)

(73) Assignee: Aisin Seiki Kabushiki Kaisha, Kariya, Aichi-Ken (JP)

( * ) Notice: Subject to any disclaimer, the term of this patent is extended or adjusted under 35 U.S.C. 154(b) by 978 days.

(21) Appl. No.: 11/642,876

(22) Filed: Dec. 21, 2006

(65) Prior Publication Data

US 2007/0158960 A1 Jul. 12, 2007

(30) Foreign Application Priority Data

Dec. 27, 2005 (JP) ..... 2005-375818

(51) Int. Cl.
*E05B 3/00* (2006.01)

(52) U.S. Cl. ..... 292/336.3; 292/348; 292/DIG. 53

(58) Field of Classification Search ..... 292/336.3, 292/DIG. 54, DIG. 53, 347, 348; 16/110.1; 296/50; 70/224
See application file for complete search history.

(56) References Cited

U.S. PATENT DOCUMENTS 5,685,581 A * 11/1997 Kritzler et al. ..... 292/336.3
6,740,834 B2 * 5/2004 Sueyoshi et al. ..... 200/600
6,768,413 B1 * 7/2004 Kemmann et al. ..... 340/5.72
6,769,154 B1 * 8/2004 Klein et al. ..... 16/412
6,895,635 B2 * 5/2005 Tisol et al. ..... 16/110.1
6,964,439 B2 * 11/2005 Nomura et al. ..... 292/336.3
7,152,893 B2 * 12/2006 Pudney ..... 292/336.3
7,192,285 B2 * 3/2007 Makino et al. ..... 439/34
7,445,257 B2 * 11/2008 Muller et al. ..... 292/336.3
7,527,307 B2 * 5/2009 Belchine et al. ..... 292/336.3
7,598,469 B2 * 10/2009 Tanimoto et al. ..... 200/520
2003/0111850 A1 * 6/2003 Kwak ..... 292/336.3
2004/0217601 A1 * 11/2004 Garnault et al. ..... 292/336.3
2005/0006909 A1 * 1/2005 Tanimoto et al. ..... 292/201

FOREIGN PATENT DOCUMENTS

JP 2003-505626 A 2/2003
JP 2004-360273 A 12/2004

* cited by examiner

*Primary Examiner* — Kristina Fulton
(74) *Attorney, Agent, or Firm* — Buchanan Ingersoll & Rooney PC

(57) ABSTRACT

A vehicle door handle includes a handle main body, a handle cover assembled to the handle main body by means of a first assembly portion and a second assembly portion, and the second assembly portion including: a first engagement portion having a recessed portion and a protruding portion; and a second engagement portion provided at the other of the handle main body and the handle cover and having a hook portion hooking over the first engagement portion, wherein, the handle cover engages the handle main body by rotating at least either one of the handle cover and the handle main body while the second engagement portion hooks over the first engagement portion in a manner where a top end of the hook portion of the second engagement portion is positioned within the recessed portion of the first engagement portion.

15 Claims, 6 Drawing Sheets

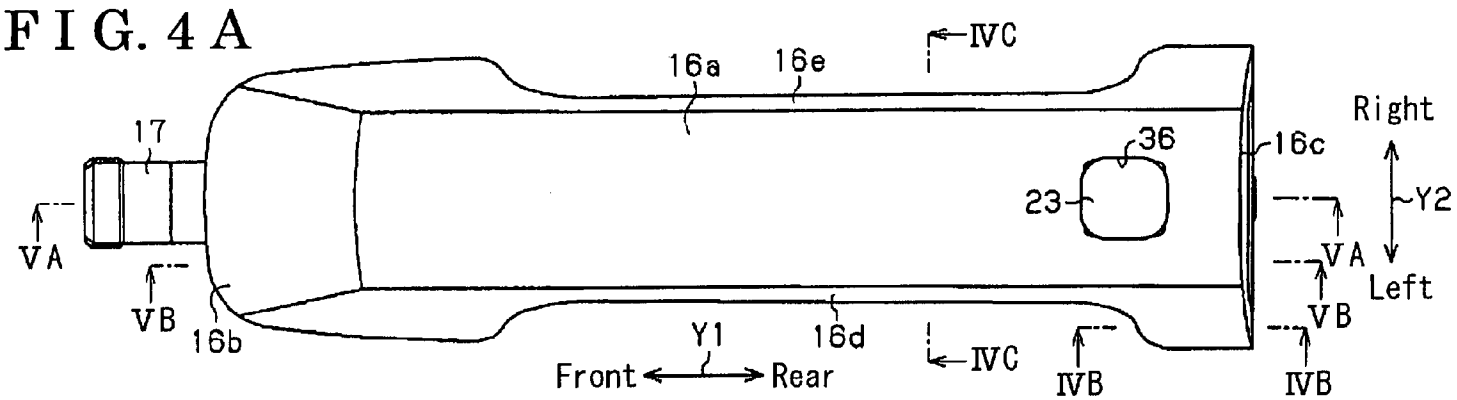
FIG. 4 A
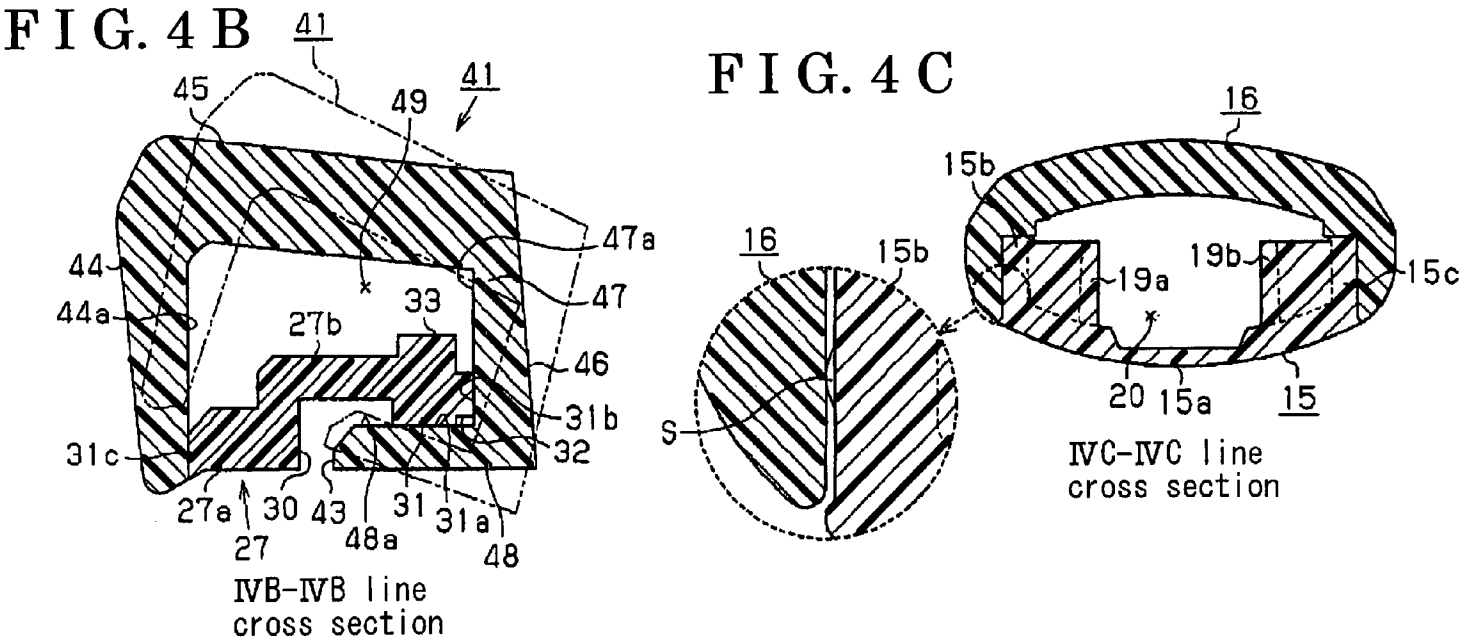
FIG. 4 B
FIG. 4 C

VEHICLE DOOR HANDLE

CROSS REFERENCE TO RELATED APPLICATIONS

This application is based on and claims priority under 35 U.S.C. §119 to Japanese Patent Application 2005-375818 filed on Dec. 27, 2005, the entire content of which is incorporated herein by reference.

FIELD OF THE INVENTION

The present invention relates to a vehicle door handle, which is attached to a vehicle door and is used for opening and closing the door.

BACKGROUND

A known vehicle door handle for opening and closing a vehicle door has been disclosed, for example, in JP2004-360273A and JP2003-505626A. A door handle has been known that includes a handle main body and a handle cover, wherein the handle cover is assembled onto the handle main body. The vehicle door handle described in JP2004-360273A is finished by assembling a handle cover onto a handle main body, and by tightening them with a tightening member such as a screw. The vehicle door handle described in JP2003-505626A includes a handle main body formed with a recessed portion (a groove), and a handle cover formed with a protruding portion that is engageable with the recessed portion. By engaging the protruding portion with the recessed portion, the handle cover can be assembled onto the handle main body.

However, according to the vehicle door handle described in JP2004-360273, due to its structure where the tightening takes place at two locations, much time and effort are required for an assembly operation thereof. The vehicle door handle described in JP2003-505626 has a structure whereby the handle cover is engaged with the handle main body, and thus, at first glance, an assembly operation appears to be easier than that in a case where the tightening is performed as in JP2004-360273. However, in order to engage the handle cover with the handle main body, it is necessary to deform the handle cover. At such a time, if the handle cover is deformed in a manner where an excessive force applied thereto, the handle cover may be broken. To prevent this, much care is required in the course of an assembly operation. As a result, much time and effort are still required for an assembly operation, as in the case of the vehicle door handle described in JP2004-360273.

Further, in recent years, according to the vehicle doors, keyless entry system has become increasingly popular. In a vehicle equipped with a keyless entry system, electronic parts for the keyless entry system are accommodated in the vehicle door handle. Thus, if a problem occurs in these electronic parts, the vehicle door handle needs to be detached from the door, the handle cover is removed from the handle main body, and the electronic part is replaced with a new part. Therefore, it is preferable for the vehicle door handle to have a structure in which an assembly operation (including removal) can be conducted easily, taking into due consideration not only the stage of manufacturing but also times when maintenance is required.

The present invention has been made in view of the circumstances described above, and a need thus exists to provide a vehicle door handle whereby it becomes possible to assemble a handle main body and a handle cover easily so as to achieve increased ease of assembly.

SUMMARY OF THE INVENTION

According to an aspect of the present invention, a vehicle door handle attached to a vehicle door and operated to open and close the vehicle door includes: a handle main body; a handle cover assembled to the handle main body by means of a first assembly portion and a second assembly portion; the first assembly portion used for tightening the handle cover to the handle main body; the second assembly portion used for engaging the handle cover with the handle main body, and the second assembly including: a first engagement portion provided at one of the handle main body and the handle cover and having: a recessed portion opening in one direction of the vehicle door handle; and a protruding portion protruding in one direction of the vehicle door handle and provided so as to be aligned with the recessed portion; and a second engagement portion provided at the other of the handle main body and the handle cover and having a hook portion hooking over the first engagement portion, wherein, the handle cover engages the handle main body by rotating one of the handle cover and the handle main body while the second engagement portion hooks over the first engagement portion in a manner where a top end of the hook portion of the second engagement portion is positioned within the recessed portion of the first engagement portion.

BRIEF DESCRIPTION OF THE DRAWINGS

The foregoing and additional features and characteristics of the present invention 20 will become more apparent from the following detailed description considered with reference to the accompanying drawings, wherein:

FIG. 4A is a plane view of the handle portion, as seen from a surface side thereof;

FIG. 4B is a cross-sectional view taken along the line IVB-IVB of FIG. 4A;

FIG. 4C is a cross-sectional view taken along the line IVC-IVC of FIG. 4A;

DETAILED DESCRIPTION

Figure 1:
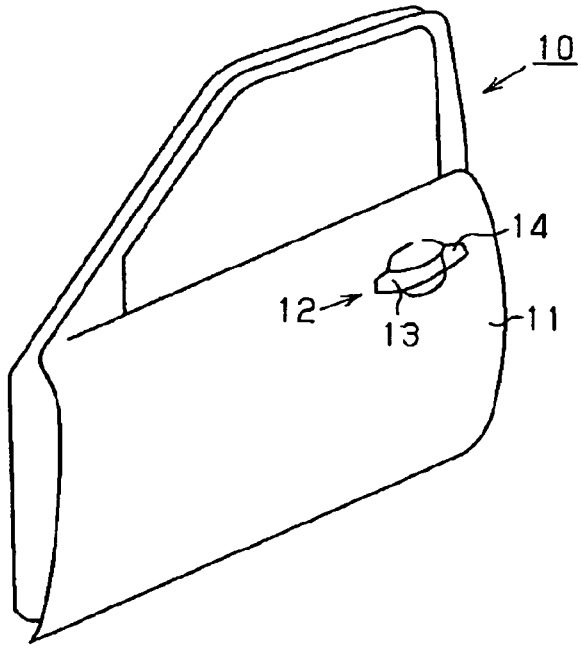
FIG. 1 is a perspective view of a vehicle door equipped with a handle portion.
Figure 2:
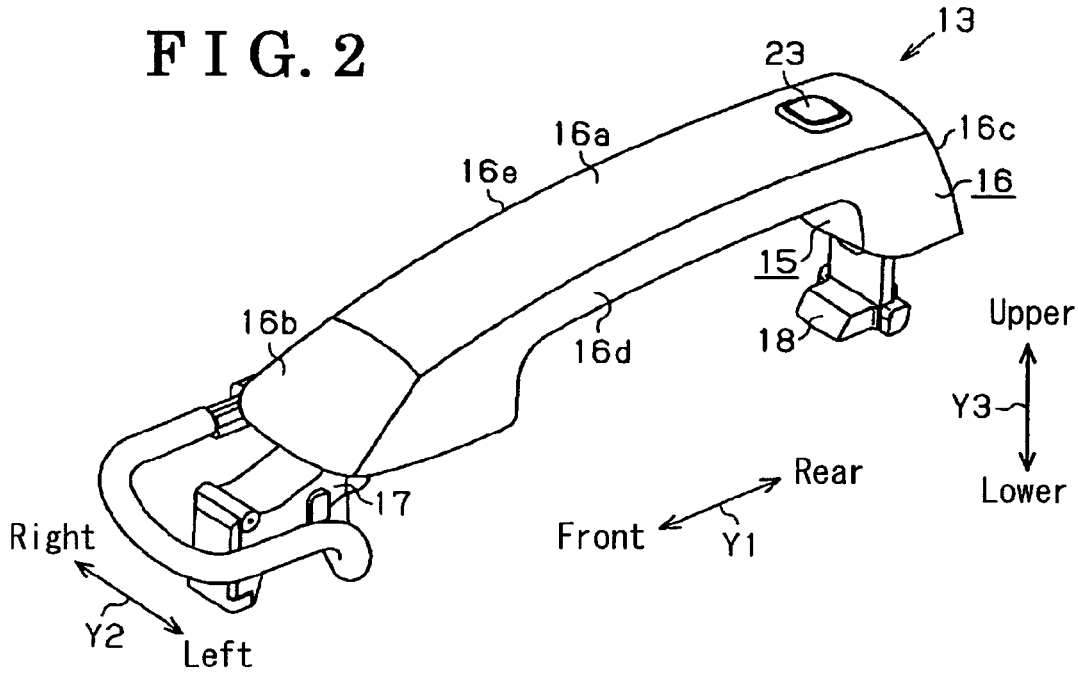
FIG. 2 is a perspective view of a assembled state of a handle portion.

Hereinafter, an embodiment of the present invention, as applied to a vehicle door handle will be described in accordance with FIGS. 1 to 8. First, a door 10 for a vehicle provided at a side portion of the vehicle will be described on the basis of FIG. 1. FIG. 1 is a perspective view of a vehicle door 10 mounted to the vehicle at the passenger seat side. As illustrated in FIG. 1, the vehicle door 10 includes a door panel 11. A door handle 12 for a vehicle is mounted onto the door panel 11 so as to protrude in an outward direction. The vehicle door handle 12 includes: a handle portion 13 as a grip portion that is gripped at the time that the vehicle door 10 is opened; and a handle cap portion 14 is provided so as to, for example, cover a key cylinder in order to create a designed surface. The handle portion 13 is a member which is gripped for opening and closing the door mechanically. The handle portion 13 and the handle cap portion 14 are supported by a door frame, which is not illustrated, with the door panel 11 interposed therebetween.

Next, a structure of the handle portion 13 of the vehicle door handle 12 will be described in detail in accordance with FIGS. 2 through 8. In the following description, the "front", "back", "left", "right", "up" and "down" sides of the handle portion 13 are deemed to be forward and rearward directions along the direction of arrow Y1 in the drawings, the direction of arrow Y2 in the drawings as leftward and rightward directions, and the direction of arrow Y3 in the drawings as upward and downward directions.

The forward and rearward direction, the leftward and rightward direction, and the upward and downward direction that have been mentioned above are defined in such a manner that, while the handle portion 13 is mounted onto the door panel 11, the "forward and rearward directions" correspond to the frontward and rearward directions of the vehicle (i.e. the length direction of the vehicle), the "leftward and rightward" directions correspond to the upward and downward directions of the vehicle (i.e. the height direction of the vehicle), and the "upward and downward directions" correspond to the leftward and rightward directions of the vehicle (i.e. the width direction of the vehicle).

Figure 3:
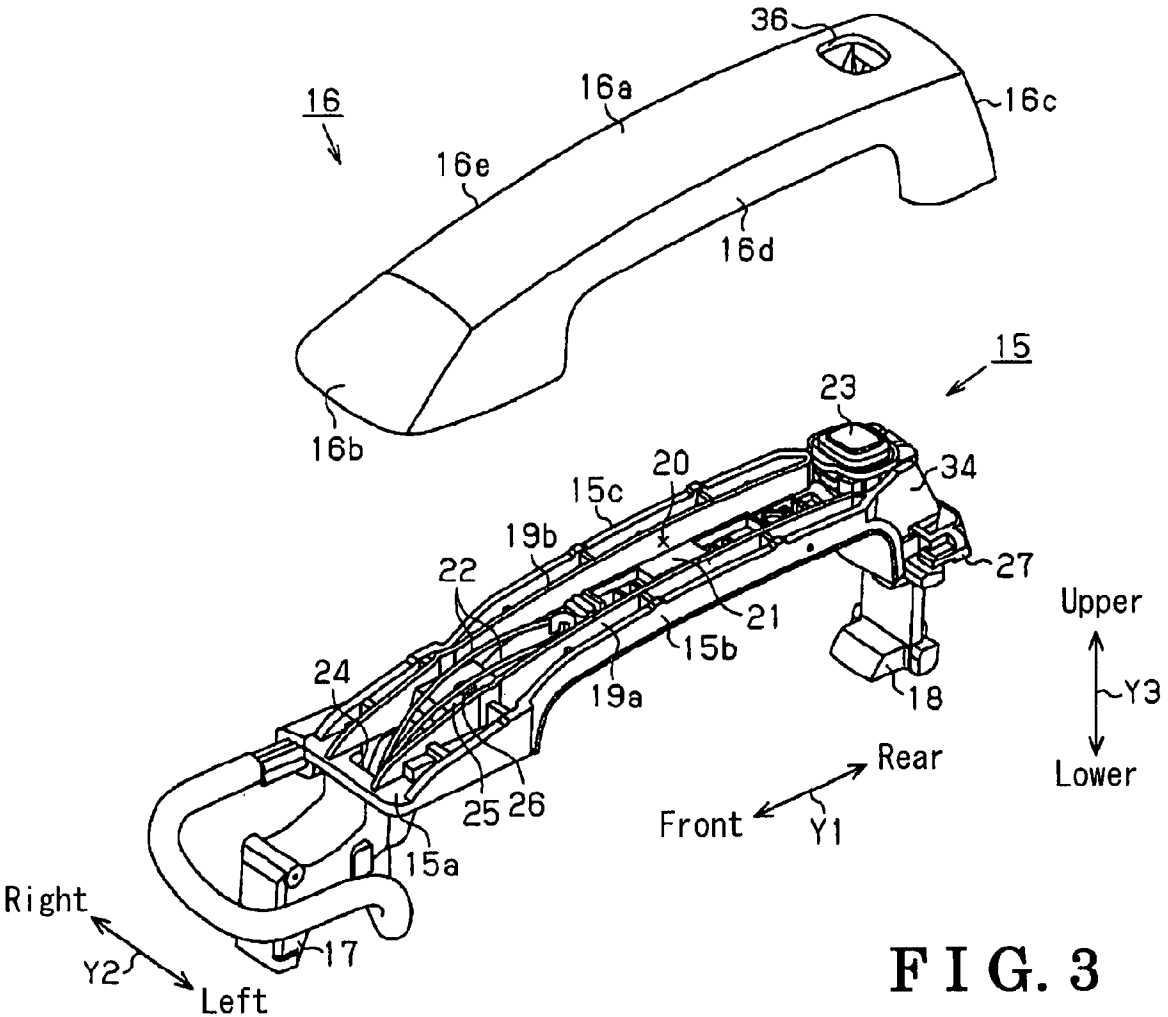
FIG. 3 is an exploded perspective view of the handle portion.

The handle portion 13 includes a handle main body 15 and a handle cover 16 that is assembled onto the handle main body 15 (see FIG. 3). In this embodiment, both the handle main body 15 and the handle cover 16 are made of resin material. Further, in this embodiment, the handle main body 15 and the handle cover 16 are formed in an elongated shape. Specifically, the handle main body 15 is formed with a main body left side wall 15*b*, a main body right side wall 15*c* and a bottom plate 15*a* in a manner where the main body left side wall 15*b* and the main body right side wall 15*c* are provided so as be an upright posture at the left and right edges of the bottom plate 15*a* that adopts the shape of rectangle as seen from its front. The bottom plate 15*a* is formed so as to raise upward at a central portion thereof in the frontward and rearward directions of the handle main body 15, as illustrated in FIG. 3. At the under surface of the bottom plate 15, a front arm portion 17 and a rear arm portion 18 are provided in a manner where: the front arm portion 17 extends downward therefrom at the front end side of the handle main body 15; and the rear arm portion 18 extends downward therefrom at the rear end side of the handle main body 15.

On the upper surface of the bottom wall 15 at locations between the main body left side wall 15*b* and the main body right side wall 15*c*, a left accommodating wall 19*a* and a right accommodating wall 19*b* are provided so as to be in an upright posture from the handle main body 15 along the frontward and rearward directions thereof. Each of the left accommodating wall 19*a* and the right accommodating wall 19*b* functions as a partition so as to regulate an accommodating portion 20, in which various electronic parts are housed, on the upper surface of the bottom plate 15*a* between the main body left side wall 15*b* and the main body right side wall 15*c*.

In this embodiment, the accommodation portion 20 accommodates, a sensing antenna 21, a harness 22 and a lock-unlock switch 23, which are serving as electronic parts. The lock-unlock switch 23 is for purposes of locking and unlock the vehicle door (illustrated in FIG. 1). The sensing antenna 21 is for purposes of detecting the presence or otherwise of a person who might be manipulating the vehicle door handle 12. Each of the sensing antenna 21 and the lock-unlock switch 23 is connected by way of a harness 22 to an unillustrated vehicle, especially a control unit mounted onto the vehicle. The harness 22 is distributed from the accommodating portion 20 of the handle main body 15 to the outside of the handle main body 15 through a penetrating hole 24 formed on the bottom plate 15*a* at its front end side thereof.

A screw-tightening portion 25, serving as a first assembly portion, is formed on the upper surface of the bottom plate 15*a* at the front end side of the handle main body 15. At a central portion of the screw-tightening portion 25, a screw hole 26 is formed into which a screw N, serving as a tightening member, can be screwed. At the rear end side of the handle main body 15, a pair of left and right main body-side engagement pieces (first engagement portions) 27 and 28, which together serves as a second assembly portion, are provided so as to project respectively in a leftward and rightward direction of the handle main body 15 (see FIGS. 3, 4B, 6, and 7).

At this point, a specific structure (shape) of the individual main body-side engagement pieces 27 and 28 will be described with reference to FIG. 4B. The main body-side engagement piece 27 is formed so as to project leftward of the handle main body 15, and the main body-side engagement piece 28 is formed so as to project rightward of the handle main body 15, and each of them has an identical structure (an identical shape). Therefore, in the following description, the main body-side engagement piece 27 will be described.

The main body-side engagement piece 27 is molded in a stepped shape so as to integrally has a first horizontal piece 27*a* and a second horizontal piece 27*b* as illustrated in FIG. 4B. The first horizontal piece 27*a* is located at the front side of the handle main body 15, whereas the second horizontal piece 27*b* is located at the rear side of the handle main body 15. On the lower surface of the main body-side engagement piece 27 (i.e. on the lower surface of the second horizontal piece 27*b*), a recessed portion 30 that opens downward of the handle main body 15 is formed at a central portion in a width direction of the handle main body 15, along the frontward and rearward directions of the handle main body 15. Further, on the lower surface of the main body-side engagement piece 27 (i.e. on the lower surface of the second horizontal piece 27*b*), a protruding portion 31 is formed adjacent to the recessed portion 30 at a position that is closer to the rear side of the handle main body 15 than is the position of the recessed portion 30. That is to say, the protruding portion 31 is provided along with the recessed portion 30. The protruding portion 31 is formed so as to protrude downward of the handle main body 15. According to outer circumferential surfaces constituting the protruding portion 31, a surface that is horizontal along the frontward and rearward directions of the handle main body 15 serves as a first contact surface 31*a*.

Further, according to side surfaces located at front and rear of the main body-side engagement piece 27 (i.e. surfaces intersecting the first contact surfaces 31*a*), the rear side surface serves as a second contact surface 31*b*, and the front side surface serves as a third contact surface 31*c*. In this embodiment, the second contact surface 31*b* is a surface that is formed on the second horizontal piece 27*b*, and the third contact surface 31*c* is a surface that is formed on the first horizontal piece 27*a*. Further, on the main body-side engagement piece 27 (i.e. the second horizontal piece 27*b*), a first contact surface 31*a* and a second contact surface 31*b* are provided so as to be contiguous with one another by way of a notch 32 that is cut into the shape of rectangle, as seen from its side.

The notch 32 is formed by cutting away the corner formed in a manner where the first contact surface 31*a* extending in a horizontal direction intersects with the second contact surface 31*b* extending in a vertical direction. Further, on the upper surface of the main body-side engagement piece 27 (i.e. on the upper surface of the second horizontal piece 27*b*), a rib 33 provided for purposes of reinforcement is formed on the opposite side of the protruding portion 31. Because of the reinforcement rib 33, at a position where the protruding portion 31 and the reinforcement rib 33 are formed, a thickness of the main body-side engagement piece 27 along upward and downward directions of the handle main body 15 is increased.

Each of the outer surfaces of the main body left side wall 15*b* and the main body right side wall 15*c* of the handle main body 15 is grained so as to form a plurality of grains (projections) S thereat. The enlarged diagram of FIG. 4C illustrates a grain S formed on the outer surface of the main body left side wall 15*b*.

Thus, while handle cover 16 is assembled onto the handle main body 15, the grains S are interposed between the side wall of the handle main body 15 in a width direction thereof and the side wall of the handle cover 16 in a width direction thereof.

Specifically, the grains S are provided between the main body left side wall 15*b* formed at the left side in a width direction of the handle main body 15 and the cover left side wall 16*d* formed at the left side in a width direction of the handle cover 16, and between the main body right side wall 15*c* formed at the right side in a width direction of the handle main body 15 and the cover right side wall 15*e* formed at the right side in a width direction of the handle cover 16.

Figure 6:
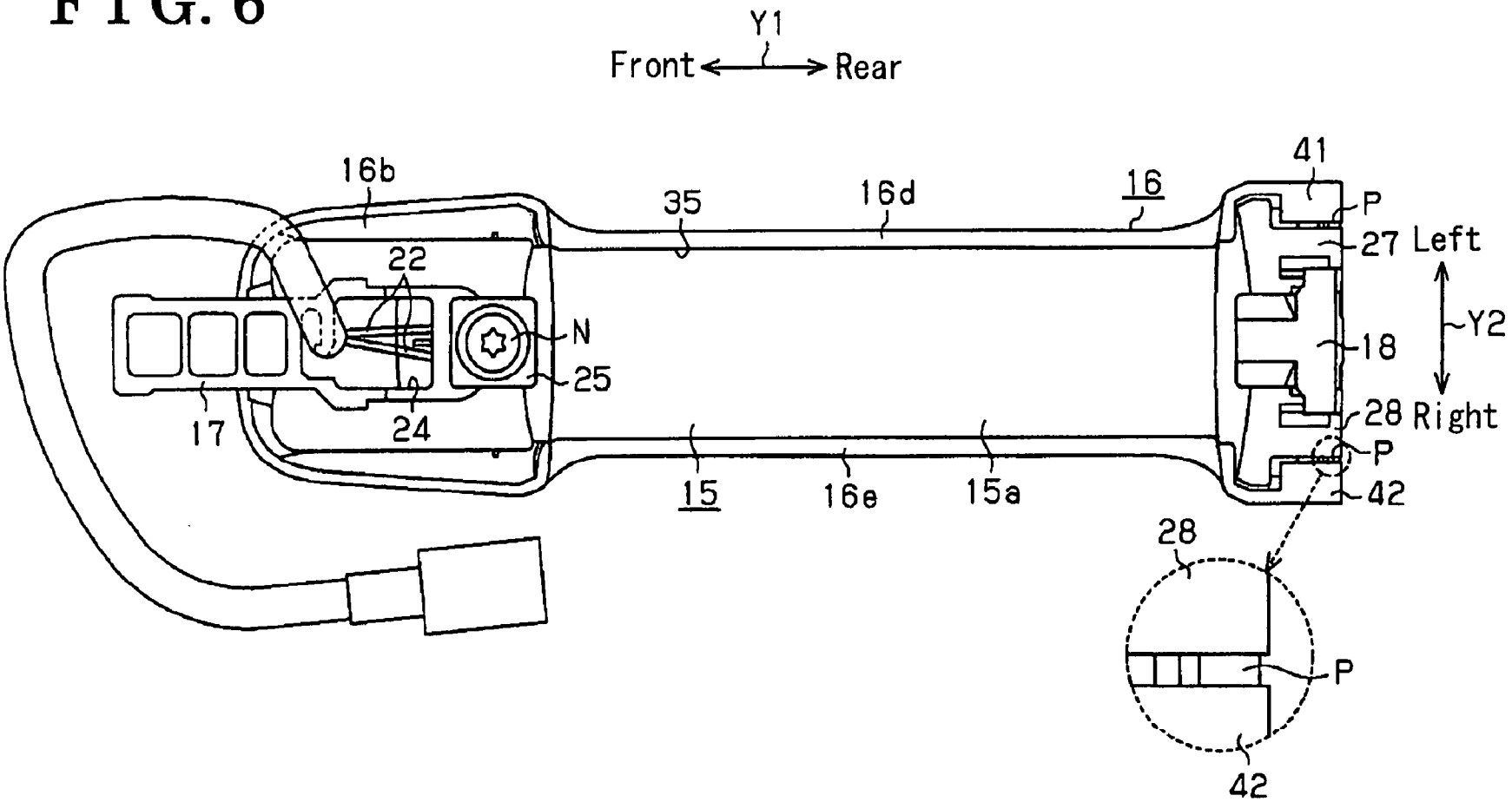
FIG. 6 is a plane view of the handle portion, as seen from the back surface side thereof.
Figure 7:
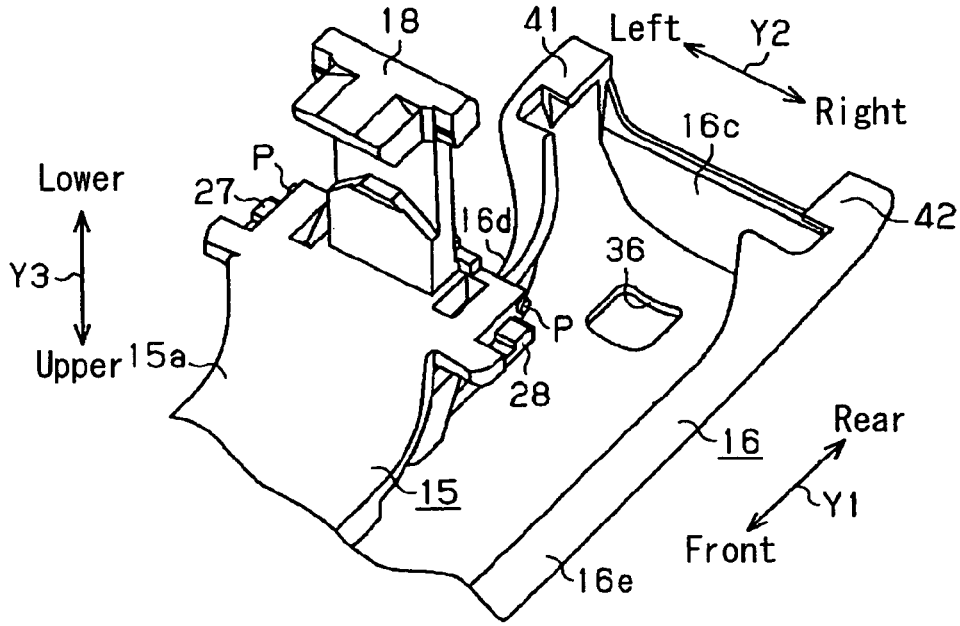
FIG. 7 is a perspective view of the handle portion at the rear side thereof, before the handle cover has been assembled onto the handle main body.

Further, at the rear end side of the handle main body 15 (i.e. above the rear arm portion 18 and in the vicinity of each of the main body-side engagement pieces 27 (and 28)), a pair of left and right bosses P is formed so as to protrude in leftward and rightward directions of the handle main body 15 (see FIGS. 6 and 7). One of the pair of bosses P is provided on the left side of the handle main body 15, and the other of the pair of bosses P is provided on the right side of the handle main body 15. In this configuration, at a time when the handle cover 16 is assembled onto the handle main body 15, the handle cover 16 can be positioned relative to the handle main body 15 by means of the bosses P.

Further, at the rear end side of the handle main body 15, a pair of left and right supporting walls 34 is provided so as to be in an upright posture relative to the bottom plate 15*a* and extending in the leftward and rightward direction of the handle main body 15, and the lock-unlock switch 23 is housed within the handle main body 15 in a manner where a lower portion of the lock-unlock switch 23 is sandwiched between the left and right supporting walls 34 (FIGS. 3 and 4).

The supporting wall 34 disposed at the left side of the handle main body 15 is provided so as to be contiguous with the main body left side wall 15*b* and the left accommodating wall 19*a*.

On the other hand, the supporting wall 34 disposed at the right side of the handle main body 15 is provided so as to be contiguous with the main body right side wall 15*c* and the right accommodating wall 19*b*.

In addition, while the handle cover 16 is assembled onto the handle main body 15, the supporting walls 34 support the handle cover 16.

Next, the handle cover 16 will be described in detail.

The handle cover 16 is formed into a box shape constituted by a cover front side wall 16*b*, a cover rear side wall 16*c*, a cover left side wall 16*d*, and a cover right side wall 16*e*, respectively provided so as to stand relative to a top plate 16*a* formed in a rectangle shape. An opening 35 is formed by the top end portions of the individual side walls 16*b* to 16*e* (see FIG. 6) of the handle cover 16. Each of the side walls 16*b* to 16*e* is provided so as to be tilted in such a manner that the individual top end sides are located more outward of the handle cover 16 than their individual base end sides. According to this structure, the handle cover 16 is in a shape that has its width enlarged from the top plate 16*a* toward the opening 35, in frontward and rearward directions, and in leftward and rightward directions. In his configuration, the area of the opening 35 is larger than the area of the top plate 16*a*.

The opening 35 of the handle cover 16 is formed into a size that is capable of accommodating a bottom plate 15*a*, the main body left side wall 15*b*, and the main body right side wall 15*c* of the handle main body 15 at a time when the handle cover 16 is assembled onto the handle main body 15. Specifically, as illustrated in FIG. 6, the handle cover 16 is formed into a size that is capable of covering the outer surfaces of the handle main body 15. Further, in conformity with the bulging shape of the bottom plate 15*a*, the cover left side wall 16*d* and the cover right side wall 16*e* are recessed at a central portion in the frontward and rearward directions of the handle cover 16. The cover left side wall 16*d* and the cover right side wall 16*e* thus conform with the shape of the bottom plate 15*a* of the handle main body 15.

Further, the top plate 16*a* of the handle cover 16 is formed with a penetrating hole 36 penetrating through the top plate 16*a* at a position corresponding to the lock-unlock switch 23 accommodated within the handle main body 15. After the handle cover 16 has been assembled onto the handle main body 15, the lock-unlock switch 23 protrudes outside the handle portion 13 through the penetrating hole 36 so as to be operated by a user. Further, on the lower surface of the top plate 16*a* of the handle cover 16 (i.e. inside the handle cover 16) and at the position close to the front end of the handle cover 16, a screw-receiving portion 37, serving as the first assembly portion, is formed (see FIG. 5A). At the center of the screw-receiving portion 37, a screw hole 38 is formed which is aligned with the screw hole 26 formed at the screw-tightening portion 25 of the handle main body 15, into which the screw N is screwed at a time when the handle cover 16 is assembled onto the handle main body 15.

Further on the inner surfaces of the cover left side wall 16*d* and the cover right side wall 16*e* at positions close to the rear sides thereof and at the rear end side of the handle cover 16, a pair of left and right cover-side engagement pieces (second engagement portions) 41 and 42 are provided. These engagement pieces together function as a second assembly portion and protrude toward the inside of the handle cover 16 in leftward and rightward directions thereof (see FIGS. 4B, 6, and 7).

In this context, a specific structure (shape) of the cover-side engagement pieces 41 and 42 will now be described with reference to FIG. 4B. Since the cover-side engagement piece 41 provided on the cover left side wall 16*d* of the handle cover 16 is of an identical structure (an identical shape) to the cover-side engagement piece 42 provided on the cover right side wall 16*e* of the handle cover 16, in the following description, the cover-side engagement piece 41 will be described.

The cover-side engagement piece 41 is molded in such a way that in its entirety it assumes a rectangular shape, as seen from its side, and is formed partially with an opening 43 opening in a downward direction of the handle cover 16. The cover-side engagement piece 41 is constituted by a first longitudinal wall portion 44, a first lateral wall portion 45, and a hook portion 46. The first longitudinal wall portion 44 is provided close to the front side of the handle cover 16 and extends into upward and downward directions. The first lateral wall portion 45 is provided so as to be contiguous with the first longitudinal wall portion 44 and extends in forward and rearward directions of the handle cover 16. Further, the hook portion 46 includes a second longitudinal wall portion 47 provided close to the rear side of the handle cover 16 and extending into an upward direction, and a second lateral wall portion 48 provided so as to be contiguous with the second longitudinal wall portion 47 and extending in frontward and rearward directions in such a manner that its top end faces the front side of the handle cover 16. The cover-side engagement piece 41 is molded integrally with the first longitudinal wall portion 44, the first lateral wall portion 45, and the hook portion 46 (including the second lateral wall portion 47 and the second lateral wall portion 48), in such a way that an enclosed region 49, regulated by these portions 44 to 46, is formed. The enclosed region 49 is formed in a size that is capable of accommodating the main body-side engagement piece 27 of the handle main body 15, as well as being capable of coming into contact with the individual contact surfaces 31*a*, 31*b* and 31*c* of the main body-side engagement piece 27 while the handle cover 16 is being assembled onto the handle main body 15.

The inner surface of the first longitudinal wall portion 44 is formed as an opposite surface 44*a*, serving as a third opposite surface, which is opposite to a third contact surface 31*c* formed on the main body-side engagement piece 27, and which comes into surface-contact with the third contact surface 31*c* when the handle cover 16 is being assembled onto the handle main body 15. The inner surface of the second longitudinal wall portion 47 of the hook portion 46 is formed as an opposite surface 47*a*, serving as a second opposite surface, which is opposite to a second contact surface 31*b* formed on the main body-side engagement piece 27, and which comes into surface-contact with the second contact surface 31*b* when the handle cover 16 is being assembled onto the handle main body 15. The inner surface of the lateral wall portion 48 of the hook portion 46 is formed as an opposite surface 48*a*, serving as a first opposite surface, which is opposite to a first contact surface 31*a* formed on the main body-side engagement piece 27 and comes into surface-contact with the first contact surface 31*a* when the handle cover 16 is being assembled onto the handle main body 15. Specifically, in this embodiment, the cover-side engagement piece 41 includes three opposite surfaces 44*a*, 47*a*, and 48*a* that are separately brought into contact with the respective contact surfaces 31*a*, 31*b* and 31*c* of the main body-side engagement piece 27.

Figure 5A:
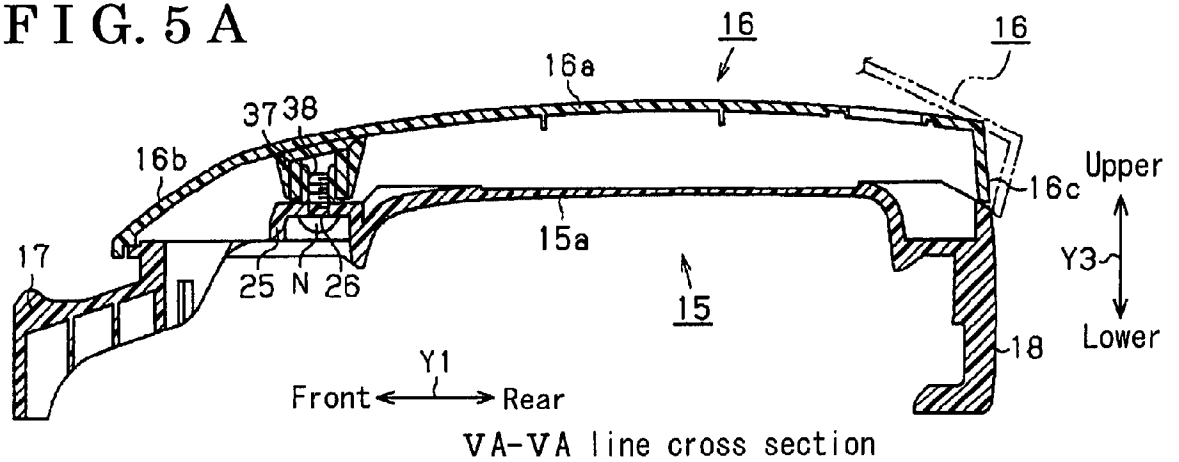
FIG. 5A is a cross-sectional view taken along the line VA-VA of FIG. 4A.
Figure 5B:
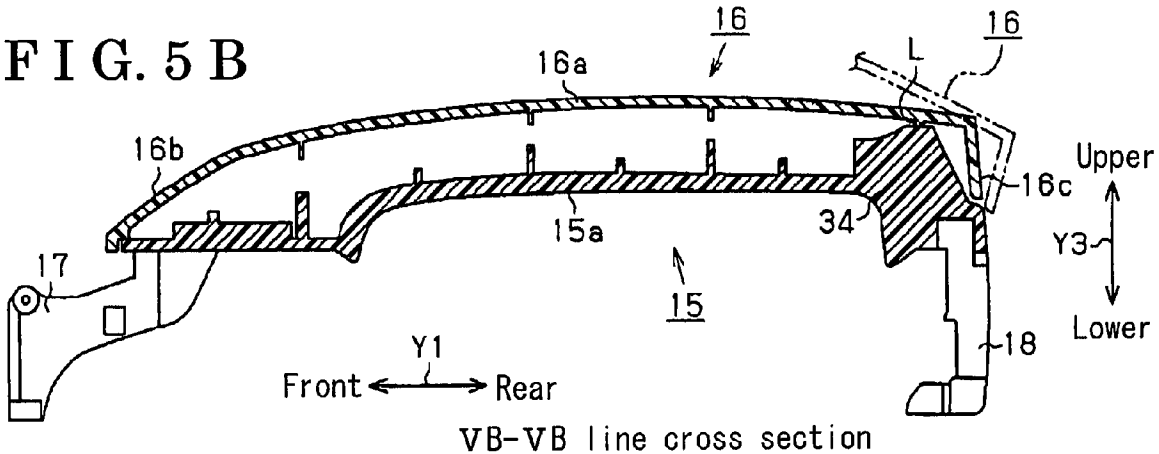
FIG. 5B is a cross-sectional view taken along the line VB-VB of FIG. 4A.

On the lower surface of the top plate 16*a* of the handle cover 16 at a location close to the rear end of the handle cover 16, a pair of left and right supporting projections L is formed so as to protrude downward (see FIG. 5B). The supporting projections L come into contact with the upper surfaces of the supporting walls 34 of the handle main body 15 while the handle cover 16 is being assembled onto the handle main body 15. In this embodiment, the handle cover 16 is structured in such a manner that a distance from the top end of the supporting projection L to the opposite surface 48*a* formed on the hook portion 46 (i.e. the length in upward and downward directions) is shorter than a distance from the upper surface of the supporting wall 34 of the handle main body 15 to the first contact surface 31*a* formed as a protruding portion 31 (i.e. the length in upward and downward directions).

Next, assembly of the handle cover 16 onto the handle main body 15 will be described. In order to assemble the handle cover 16 to the handle main body 15, electronic parts such as the sensing antenna 21 and the lock-unlock switch 23 are first of all accommodated into a housing portion 20 of the handle main body 15. Then, as illustrated in FIG. 7, while the handle main body 15 is aligned with the handle cover 16 so as to be in the frontward and rearward directions thereof, assembly is started at the rear end side of the vehicle door handle 12. Specifically, according to the vehicle door handle 12 in this embodiment, the main body-side engagement pieces 27 and 28, together serving as the second assembling portion, are engaged first of all with the cover-side engagement pieces 41 and 42.

Figure 8:
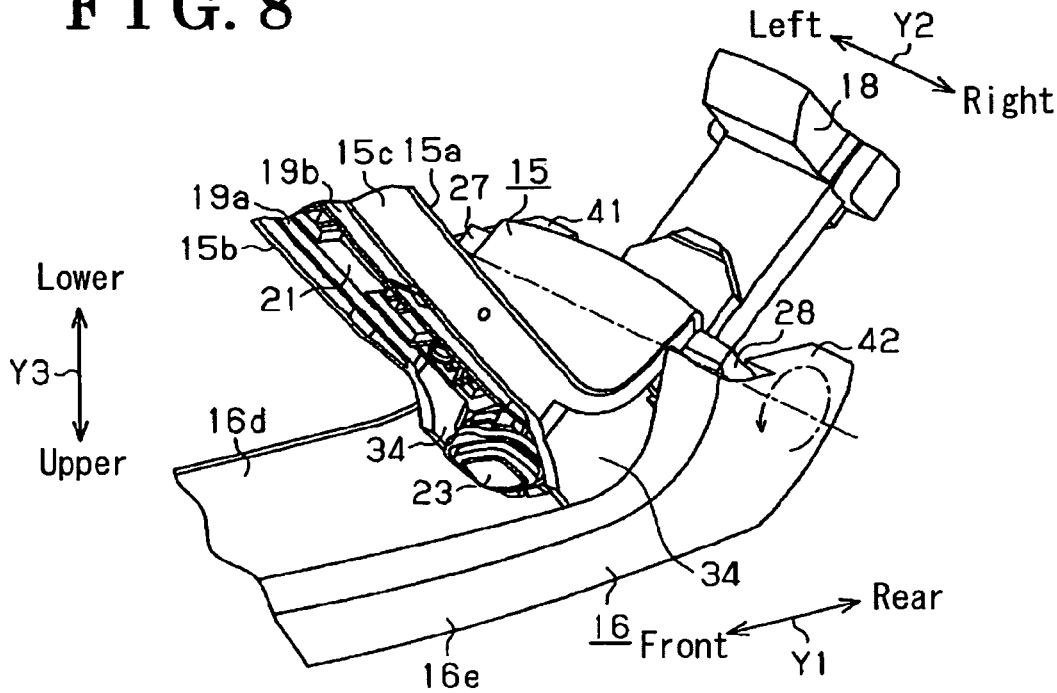
FIG. 8 is a perspective view of the handle portion at the rear side thereof, at a time when the handle cover is being assembled onto the handle main body.

Specifically, as illustrated in FIG. 8, with the handle main body 15 tilted at a predetermined angle relative to the handle cover 16, each of the main body-side engagement pieces 27 and 28 of the handle main body 15 are inserted into each of the openings 43 formed in the cover-side engagement pieces 41 and 42 of the handle cover 16.

At this point, the main body-side engagement pieces 27 and 28 of the handle main body 15 and the cover-side engagement pieces 41 and 42 of the handle cover 16 are in a positional relationship indicated, in FIG. 4B, by a solid line, representing the main body-side engagement pieces 27 and 28, and by a double-dotted line, representing the cover-side engagement pieces 41 and 42.

In other words, the top end of each hook portion 46 of each cover-side engagement piece 41 and 42 is located within each recessed portion 30 of each main body-side engagement pieces 27 and 28, and each hook portion 46 hooks over each main body-side engagement pieces 27 and 28. In such a state, the main body-side engagement pieces 27 and 28 are accommodated in a tilted state within each enclosed regions 49 of the cover-side engagement pieces 41 and 42. In FIGS. 5A and 5B, the handle cover 16 positioned in a manner where the cover-side engagement pieces 41 and 42 hook over the main body-side engagement pieces 27 and 28, is represented by a double-dotted line.

Next, the handle main body 15 positioned in the state shown in FIG. 8, is rotated in a direction represented by an arrow in FIG. 8, that is, toward the opening 35 of the handle cover 16, so that the handle main body 15 is accommodated into the handle cover 16. It should be noted that, FIG. 8 is illustrated on an assumption that the handle main body 15 is being rotated in a direction indicated by the arrow, however, the handle cover 16 positioned in the state shown in FIG. 8, may be rotated alternatively. In such a case, the handle cover 16 is rotated in an opposite direction to the arrow in FIG. 8, in other words, the handle cover 16 is rotated in a direction along which the handle cover 16 approaches the handle main body 15.

In a state where the handle main body 15 is accommodated within the handle cover 16 after the handle main body 15 is rotated in a direction indicated by the arrow in FIG. 8, the main body-side engagement pieces 27 and 28 of the handle main body 15 and the cover-side engagement pieces 41 and 42 of the handle cover 16 are in a positional relationship indicated, in FIG. 4B, by the solid line, representing the main body-side engagement pieces 27 and 28, and a solid line, representing the cover-side engagement pieces 41 and 42.

In other words, the main body-side engagement pieces 27 and 28 are rotated within each enclosed region 49 about a contact point between each protruding portion 31 and each opposite surface 48*a* of each hook portion 46, and the main body-side engagement pieces 27 and 28 are thereby accommodated within the enclosed region 49.

Each main body-side engagement piece 27 and 28 is accommodated within each enclosed region 49 in a state where each first contact surface 31*a* is in surface-contact with each opposite surface 48*a*, and each second contact surface 31*b* is in surface-contact with each opposite surface 47*a*, and each third contact surface 31*c* is in surface-contact with each opposite surface 44*a*. Further, in each enclosed region 49, each main body-side engagement pieces 27 and 28 is accommodated so as to be in a horizontal state. In such a state, the handle main body 15 and the handle cover 16 are engaged with one another in a manner where the main body-side engagement pieces 27 and 28 engages the cover-side engagement pieces 41 and 42.

As a result of the main body-side engagement pieces 27 and 28, and the cover-side engagement pieces 41 and 42 being engaged with one another, the handle cover 16 is restricted relative to the handle main body 15 at this assembly position. Specifically, as a result of surface contact between each second contact surface 31*b* and each opposite surface 47*a*, and of the surface contact between each third contact surface 31*c* and each opposite surface 44*a*, the assembly position of the handle cover 16 in forward and rearward directions is restricted (i.e. movement in forward and rearward directions is restricted). Further, the assembly position in an upward direction of the handle cover 16 is restricted due to the surface contact between each first contact surface 31*a* and each opposite surface 48*a* (i.e. movement in an upward direction is restricted).

Further, when the handle cover 16 is rotated, the handle cover 16 is brought into contact with the grains S and bosses P formed at the handle main body 15. In this embodiment, the grains S and the bosses P regulate the assembly position so as not to move in leftward and rightward directions of the handle cover 16 relative to the handle main body 15 (i.e. movement in leftward and rightward directions is restricted). Since the vehicle door handle 12 of this embodiment is of a structure where the handle main body 15 is accommodated into the handle cover 16, when the handle main body 15 is accommodated into the handle cover 16, clearances in leftward and rightward directions are formed between the outer surface of the main body left side wall 15*b* and the inner surface of the cover left side wall 16*d*, and between the outer surface of the main body right side wall 15*c* and the inner surface of the cover right side wall 16*e*. According to this structure, in this embodiment, grains S formed on the handle main body 15 serve to determine positions in leftward and rightward directions of the handle cover 16, as well as to avoid direct collisions between the side walls in cases where the handle main body 15 or the handle cover 16 moves in leftward and rightward directions thereof so that noises caused by interference each other may be reduced.

Further, when the handle cover 16 is rotated, the supporting projections L of the handle cover 16 come into contact with the upper surface of the supporting wall 34 of the handle main body 15. As a result of the contact between the supporting projections L and the supporting wall 34, the assembly position in a downward direction of the handle cover 16 is regulated (i.e. the movement in a downward direction is restricted). In a state where the main body-side engagement pieces 27 and 28 and the cover-side engagement pieces 41 and 42 are engaged with one another as a result of rotation of the handle cover 16 (before being tightened by screw N), the handle cover 16 is in a state where its front end side rises in an upward direction and is distanced from the handle main body 15. This state is caused by the distance between the top end of each supporting projections L and the opposite surface 48*a* of the hook portion 48*a* being shorter than the distance between the upper surface of each supporting wall 34 of the handle main body 15 and the first contact surface 31*a* of the protruding portion 31.

After that, the screw N is screwed into the screw-tightening portion 25 of the handle main body 15 and the screw receiving portion 37 of the handle cover 16 that constitutes the first assembly portion, in such a way as to assemble them. In such a state, the handle main body 15 and the handle cover 16 are completely assembled so as to be served as the handle portion 13 that constitutes the vehicle door handle 12. Further, at a time of assembly to complete the handle portion 13 of this embodiment, as a result of the force applied from the supporting wall 34 onto the supporting projections L, an upward force is applied onto the rear side of the handle cover 16. On the other hand, as a result of tightening by the screw N, a downward force is applied onto the front side of the handle cover 16. As a result of the application of these forces, in the handle portion 13 of this embodiment, although the handle cover 16 is warped when it is tightened by a force applied in a downward direction, the handle cover 16 is simultaneously pushed up by a force applied in an upward direction. In this manner, warping of the handle cover 16 can be eliminated.

Next, a method for detaching the handle cover 16 from the handle main body 15 after assembly will be described. Detachment is performed at the time of maintenance, for example the replacement of an electronic part accommodated in the handle main body 15.

The handle cover 16 is detached from the handle main body 15 in ways that reversing the assembly process described above. Specifically, the screw N that has been screwed into the screw-tightening portion 25 and the screw-receiving portion 37 is removed at first. After the screw N has been removed, by virtue of the force in an upward direction which the supporting projections L receive from the supporting wall 34, the front end side of the handle cover 16 rises in an upward direction and is distanced from the handle main body 15. Then, the handle main body 15 or the handle cover 16 is rotated in a direction where the handle main body 15 and the handle cover 16 are apart from each other. As a result, the engagement between the main body-side engagement pieces 27 and 28 and the cover-side engagement pieces 41 and 42 is brought to an end. Then, the handle main body 15 is withdrawn away from the handle cover 16 in an oblique direction, and the handle main body 15 can thus be separated (disassembled) from the handle cover 16.

Thus, according to this embodiment, the following effects can be obtained.

(1) The handle main body 15 and the handle cover 16 are assembled by means of tightening a screw N at one location (i.e. a first assembly portion) and by engagement between the main body-side engagement pieces 27, 28 and the cover-side engagement pieces 41, 42 (i.e. a second assembly portion). Since tightening is performed at only one location, in comparison with cases where plural locations are tightened, assembly is facilitated. Further, as another assembly portion that is additional to the assembly portion created by tightening, the main body-side engagement pieces 27, 28 is hooked by the cover-side engagement pieces 41, 42, and, in this state, the handle cover 16 is rotated relative to the handle main body 15 so as to be assembled therewith. This structure facilitates assembly and also inhibits deformation (breakage) of the handle main body 15 and the cover 16 at a time when they are assembled (including circumstances where the handle cover 16 is attached to, or detached from, the handle main body 15). In this manner, ease of assembly can be improved.

(2) Further, in circumstances where the accommodating portion 20 is formed in the handle main body 15, and the electronic parts are accommodated in the accommodating portion 20, according to the assembly structure of the handle portion 13 of this embodiment, the handle main body 15 and the handle cover 16 can be assembled during times when it is possible to confirm an accommodated state of the electronic parts. In this manner, ease of assembly can be improved.

(3) Further, according to the assembly structure of the handle portion 13 of this embodiment, ease of assembly can be improved not only in cases where the handle cover 16 is mounted onto the handle main body 15 during manufacture but also in cases where the handle cover 16 is detached from the handle main body 15 for purpose of maintenance, such as for the replacement of an electronic part. Specifically, to detach the handle cover 16 from the handle main body 15, the screw N is removed and the handle main body 15 (or the handle cover 16) is rotated in a direction where the handle main body 15 is apart from the handle cover 16 and the engagement between them is thereby brought into an end.

(4) Further, according to the structure in which the handle main body 15 hooks over the handle cover 16, or the handle cover hooks over the handle main body 15, and rotated so as to be engaged with each other, even if both the handle main body 15 and the handle cover 16 are made of resin, the handle main body 15 and the handle cover 16 can be assembled without deformation or breakage occurring during assembly.

(5) The main body-side engagement pieces 27 and 28 are formed with a first contact surface 31, a second contact surface 31*b*, and a third contact surface 31*c*. On the other hand, the cover-side engagement pieces 41 and 42 are formed with opposite surfaces 44*a*, 47*a* and 48*a*. To engage the main body-side engagement pieces 27, 28 with the cover-side engagement pieces 41, 42, the individual contact surfaces 31*a* to 31*c* are brought into surface-contact with the opposite surfaces 44*a*, 47*a*, and 48*a*, and assembly positions are thereby restricted. According to this structure, both during and after assembly, restrictive force between the handle main body 15 and the handle cover 16 can be enhanced so as to maintain an assembled state without fail and concentration of stress is also reduced so as to prevent breakages of the handle main body 15 and the handle cover 16.

(6) Further, in this embodiment, movement in forward and rearward directions of the handle cover 16 can be limited (restricted) by the surface contact between the second contact surface 31*b* and the opposite surface 47*a*, and by the surface contact between the third contact surface 31*c* and the opposite surface 48*a*. Accordingly, upward movement of the handle cover 16 can be limited (restricted) by surface contact between the third contact surface 31*c* and the opposite surface 44*a*, and the handle cover 16 can be assembled onto the handle main body 15 by simply rotating the handle cover 16 and by limiting (restricting) movement in frontward and rearward directions, as well as upward movement of the handle cover 16. In other words, it becomes possible to assemble the handle cover 16 onto the handle main body 15 without any special operation.

(7) Further, in order to assemble the handle main body 15 and the handle cover 16, the hook portions 46 of the cover-side engagement pieces 41 and 42 hooks over the main body-side engagement pieces 27, 28, and the handle main body 15 or the handle cover 16 is rotated about the contact point at which the protruding portion 31 contacts the opposite surface 48*a* of a hook portion 46. According to this structure, the handle main body 15 (or the handle cover 16) can be rotated with its rotational center fixed. Thus, the occurrence of problems, such as members being broken, or the main body-side engagement pieces 27, 28 getting caught in the insides of the cover-side engagement pieces 41, 42 during rotation, caused by deviation of the rotational center during assembly, can be avoided.

(8) Grains S have been provided in a space formed between the outer surfaces of the handle main body 15 (i.e. the main body left side wall 15*b* and the main body right side wall 15*c*) and the inner surfaces of the handle cover 16 (i.e. the cover left side walls 16*d* and the cover right side wall 16*e*). Such grains S can limit (restrict) movement of the handle cover 16 in leftward and rightward directions. Such grains S can also prevent the handle main body 15 and the handle cover 16 from being subjected to breakages, which might otherwise have been caused when these members slide and come into contact with each other at a time when they are assembled. Further, these grains S serve to prevent direct interference between the side wails of the handle main body 15 and the handle cover 16, and thus serve to eliminate noises caused by interference.

(9) The first contact surface 31*a* and the second contact surface 31*b* are provided so as to be contiguous with each other by way of the notch 32. Specifically, no corner is interposed between the first contact surface 31*a* and the second contact surface 31*b*. According to this structure, no corner exists at the main body-side engagement pieces 27 and 28, at which the main body-side engagement pieces 27 and 28 interferes the cover-side engagement pieces 41 and 42, within the enclosed region 49 enclosed by the cover-side engagement pieces 41 and 42. Thus, the first contact surface 31*a* and the second contact surface 31*b* of the main body-side engagement pieces 27, 28 can surely be brought into surface contact with the opposite surfaces 47*a*, 48*a* of the hook portion 46.

(10) The rib 33 is formed on the individual main body-side engagement pieces 27 and 28 in order to reinforce the main body-side engagement pieces 27 and 28. Thus, breakages of the main body-side engagement pieces 27 and 28 caused by force applied thereto, at a time of rotation, can accordingly be prevented.

The foregoing embodiment may be modified in the following ways.

In the foregoing embodiment, The handle main body 15 is regulated so as not to move within the handle cover 16 in an upward direction and in a frontward and rearward direction, in a manner where the first contact surface 31*a* contacts the opposite surface 48*a*, the second contact surface 31*b* contacts the opposite surface 47*a*, and the third contact surface 31*c* contacts the opposite surface 44*a*. However, the contact surfaces and the opposite surfaces may be formed at the main body-side engagement pieces 27 and 28, and the cover-side engagement pieces 41 and 42, so that the handle main body 15 is regulated so as not to move within the handle cover 16 in an upward and downward direction and in a frontward and rearward direction.

In the foregoing embodiment, the positions of the first assembly portion (constituted by the screw-tightening portion 25 and the screw-receiving portion 37) and of the second assembly portion (constituted by the main body-side engagement pieces 27, 28 and the cover-side engagement pieces 41, 42) may be reversed. Specifically, the second assembly portion may be located at the front end side of the handle portion 13, and the first assembly portion may be located at the rear end side thereof.

In the foregoing embodiment, the main body-side engagement pieces 27, 28 may alternatively be provided on the inner surface of the handle cover 15, and the cover-side engagement pieces 41, 42 may be provided on the outer surface of the handle main body 15.

In the foregoing embodiment, the process of grain formation (grains S) may alternatively be applied on the inner surfaces of the handle cover 16 (i.e. the cover left side wall 16*d* and the cover right side wall 16*e*).

In the foregoing embodiment, the electronic parts (such as the sensing antenna 21, the harness 22 and the lock-unlock switch 23) may alternatively be accommodated in the handle cover 16.

In the foregoing embodiment, the structure for assembling the handle main body 15 and the handle cover 16 may alternatively be embodied as a structure for assembling a handle portion 13 that includes no electronic parts (such as the sensing antenna 21, the harness 22, and the lock-unlock switch 23) accommodated therein. Moreover, cases where no lock-unlock switch 23 is accommodated in the handle portion 13, no through hole need to be formed on the handle cover 16.

A vehicle door handle attached to a vehicle door and operated to open and close the vehicle door includes: a handle main body; a handle cover assembled to the handle main body by means of a first assembly portion and a second assembly portion; the first assembly portion used for tightening the handle cover to the handle main body, the second assembly portion used for engaging the handle cover with the handle main body, and the second assembly including: a first engagement portion provided at one of the handle main body and the handle cover and having: a recessed portion opening in one direction of the vehicle door handle; and a protruding portion protruding in one direction of the vehicle door handle and provided so as to be aligned with the recessed portion; and a second engagement portion provided at the other of the handle main body and the handle cover and having a hook portion hooking over the first engagement portion, wherein, the handle cover engages the handle main body by rotating one of the handle cover and the handle main body while the second engagement portion hooks over the first engagement portion in a manner where a top end of the hook portion of the second engagement portion is positioned within the recessed portion of the first engagement portion.

Thus, the handle main body and the handle cover are assembled by means of tightening at the first assembly portion and by engagement between the first engagement portion and the second engagement portion at the second assembly portion. Since tightening is performed at only one location, in comparison with cases where plural locations are tightened, assembly is facilitated. Further, as another assembly portion that is additional to the assembly portion created by tightening, the first engagement portion is hooked by the second engagement portion, and, in this state, the handle cover is rotated relative to the handle main body so as to be assembled therewith. This structure facilitates assembly and also inhibits deformation (breakage) of the handle main body and the cover at a time when they are assembled (including circumstances where the handle cover is attached to, or detached from, the handle main body). In this manner, ease of assembly can be improved.

The vehicle door handle has a characteristic, wherein, the first engagement portion includes: a first contact surface formed on the protruding portion; a second contact surface formed so as to be orthogonal to the first contact surface; and a third contact surface formed so as to be orthogonal to the first contact surface and provided at an opposite side of the second contact surface relative to the recessed portion, and the second engagement portion includes a first opposite surface, a second opposite surface; and a third opposite surface, and while the second engagement portion is engaged with the first engagement portion, the first contact surface contacts the first opposite surface, the second contact surface contacts the second opposite surface, and the third contact surface contacts the third opposite surface, so that, while the handle cover is assembled to the handle main body, a position of the handle cover relative to the handle main body is regulated.

Thus, during the assembly, each contact surfaces is brought into surface-contact with each opposite surfaces, and assembly positions are thereby restricted. According to this structure, both during and after assembly, restrictive force between the handle main body and the handle cover can be enhanced so as to maintain an assembled state without fail and concentration of stress is also reduced so as to prevent breakages of the handle main body and the handle cover.

The vehicle door handle has a characteristic, wherein, a housing portion is formed at one of the handle main body and the handle cover in order to house an electronic part. Further, the vehicle door handle has a characteristic, wherein, the handle main body and the handle cover are made of resin.

Thus, the handle cover is easily assembled to the handle main body, as a result, ease of assembly can be improved.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A vehicle door handle attached to an outer panel of a vehicle door and operated to open and close the vehicle door comprising:

a handle main body possessing opposite ends spaced apart in a lengthwise direction;

a handle cover assembled to the handle main body by a first assembly portion and a second assembly portion, the handle cover possessing opposite ends spaced apart in the lengthwise direction;

the first assembly portion used for tightening the handle cover to the handle main body;

the second assembly portion used for engaging the handle cover with the handle main body, both assembly portions mounted above the outer surface of the outer panel;

the second assembly portion including:

a first engagement portion provided at one of the handle main body and the handle cover and having: a recessed portion opening in the lengthwise direction of the vehicle door handle; and a protruding portion protruding in the lengthwise direction of the vehicle door handle and positioned adjacent the recessed portion in the lengthwise direction; and a second engagement portion provided at the other of the handle main body and the handle cover and having a hook portion hooking over the first engagement portion, wherein, the handle cover is assembled to the handle main body by rotating at least either one of the handle cover and the handle main body about an axis perpendicular to the lengthwise direction, while the second engagement portion hooks over the first engagement portion, in a manner where a top end of the hook portion of the second engagement portion is positioned within the recessed portion of the first engagement portion;

the handle main body comprising a bottom plate extending between opposite end portions of the handle main body, a main body first side wall upstanding from the bottom plate and extending between the opposite end portions of the handle main body, and a main body second side wall upstanding from the bottom plate and extending between the opposite end portions of the handle main body, the main body first and second side walls each possessing an outer surface;

the cover comprising a top plate, a cover first side wall extending from the top plate and possessing an inner surface, and a cover second side wall extending from the top plate and possessing an inner surface; and the cover being assembled to the handle main body so that the top plate faces the bottom plate and is positioned in covering relation to the bottom plate, the inner surface of the cover first side wall faces the outer surface of the main body first side wall so that the cover first side wall covers the main body first side wall, and the inner surface of the cover second side wall faces the outer surface of the main body second side wall so that the cover second side wall covers the main body second side wall;

wherein the first engagement portion includes:

a first contact surface formed on the protruding portion;

a second contact surface formed so as to be orthogonal to the first contact surface; and a third contact surface formed so as to be orthogonal to the first contact surface and provided at an opposite side of the second contact surface relative to the recessed portion, and the second engagement portion includes a first opposite surface, a second opposite surface; and a third opposite surface, and while the second engagement portion is engaged with the first engagement portion, the first contact surface contacts the first opposite surface, the second contact surface contacts the second opposite surface, and the third contact surface contacts the third opposite surface, so that, while the handle cover is assembled to the handle main body, a position of the handle cover relative to the handle main body is regulated.

2. The vehicle door handle according to claim 1, wherein a housing portion is formed at one of the handle main body and the handle cover in order to house an electronic part.

3. The vehicle door handle according to claim 1, wherein the handle main body and the handle cover are made of resin.

4. The vehicle door handle according to claim 2, wherein the handle main body and the handle cover are made of resin.

5. The vehicle door handle according to claim 1, wherein a rib is formed at the first engagement portion on an opposite side of the protruding portion in order to reinforce the first engagement portion.

6. A vehicle door handle attached to an outer panel of a vehicle door and operated to open and close the vehicle door comprising:

a handle main body possessing opposite ends spaced apart in a lengthwise direction;

a handle cover assembled to the handle main body by a first assembly portion and a second assembly portion, the handle cover possessing opposite ends spaced apart in the lengthwise direction;

the handle main body comprising an accommodating portion covered by the cover, the accommodating portion accommodating at least one of a sensing antenna which senses a person and a lock-unlock switch which is operable to lock and unlock the vehicle door;

the first assembly portion used for tightening the handle cover to the handle main body;

the second assembly portion used for engaging the handle cover with the handle main body, both assembly portions mounted above the outer surface of the outer panel; the second assembly portion including:

a first engagement portion provided at one of the handle main body and the handle cover and having: a recessed portion opening in the lengthwise direction of the vehicle door handle; and a protruding portion protruding in the lengthwise direction of the vehicle door handle and positioned adjacent the recessed portion in the lengthwise direction; and a second engagement portion provided at the other of the handle main body and the handle cover and having a hook portion hooking over the first engagement portion, wherein, the handle cover is assembled to the handle main body by rotating the handle cover about an axis perpendicular to the lengthwise direction relative to the handle main body, while the second engagement portion hooks over the first engagement portion, in a manner where a top end of the hook portion of the second engagement portion is positioned within the recessed portion of the first engagement portion;

wherein the first engagement portion includes:

a first contact surface formed on the protruding portion;

a second contact surface formed so as to be orthogonal to the first contact surface; and a third contact surface formed so as to be orthogonal to the first contact surface and provided at an opposite side of the second contact surface relative to the recessed portion, and the second engagement portion includes a first opposite surface, a second opposite surface; and a third opposite surface, and while the second engagement portion is engaged with the first engagement portion, the first contact surface contacts the first opposite surface, the second contact surface contacts the second opposite surface, and the third contact surface contacts the third opposite surface, so that, while the handle cover is assembled to the handle main body, a position of the handle cover relative to the handle main body is regulated.

7. The vehicle door handle according to claim 6, wherein the accommodation portion accommodates both the sensing antenna and the lock-unlock switch which are both connected to a harness also accommodated in the accommodation portion.

8. The vehicle door handle according to claim 6, wherein the first assembly portion comprises a screw-receiving portion provided at one of the handle cover and the handle main body, and a screw hole provided at the other of the handle cover and the handle main body, and further comprising a screw which is received in the screw-receiving portion and the screw hole so that the handle cover and the handle main body are tightened together by rotating the screw.

9. The vehicle door handle according to claim 6, wherein the accommodation portion accommodates the lock-unlock switch, and the handle cover is provided with a through hole at which the lock-unlock switch is exposed to permit operation of the lock-unlock switch by way of the through hole.

10. The vehicle door handle according to claim 1, wherein the first assembly portion comprises a screw-receiving portion provided at one of the handle cover and the handle main body, and a screw hole provided at the other of the handle cover and the handle main body, and further comprising a screw which is received in the screw-receiving portion and the screw hole so that the handle cover and the handle main body are tightened together by rotation of the screw.

11. The vehicle door handle according to claim 1, wherein the handle main body accommodates an lock-unlock switch, and the handle cover is provided with a through hole at which the lock-unlock switch is exposed to permit operation of the lock-unlock switch by way of the through hole.

12. A vehicle door handle attached to an outer panel of a vehicle door and operated to open and close the vehicle door comprising:

a handle main body possessing opposite ends spaced apart in a lengthwise direction;

a handle cover assembled to the handle main body by a first assembly portion and a screw, the handle cover possessing opposite ends spaced apart in the lengthwise direction;

one of the handle main body and the handle cover being provided with a screw-receiving portion and the other of the handle main body and the handle cover being provided with a screw hole, the screw being received in both the screw hole and the screw-receiving portion to tighten the handle cover and the handle main body to each other by turning the screw;

the assembly portion effecting engagement between the handle cover with the handle main body, both assembly portions mounted above the outer surface of the outer panel; the second assembly portion including:

a first engagement portion provided at one of the handle main body and the handle cover and having: a recessed portion opening in the lengthwise direction of the vehicle door handle; and a protruding portion protruding in the lengthwise direction of the vehicle door handle and positioned adjacent the recessed portion in the lengthwise direction; and a second engagement portion provided at the other of the handle main body and the handle cover and having a hook portion hooking over the first engagement portion, wherein, the handle cover is assembled to the handle main body by rotating at least either one of the handle cover and the handle main body about an axis perpendicular to the lengthwise direction, while the second engagement portion hooks over the first engagement portion, in a manner where a top end of the hook portion of the second engagement portion is positioned within the recessed portion of the first engagement portion;

wherein the first engagement portion includes:

a first contact surface formed on the protruding portion;

a second contact surface formed so as to be orthogonal to the first contact surface; and a third contact surface formed so as to be orthogonal to the first contact surface and provided at an opposite side of the second contact surface relative to the recessed portion, and the second engagement portion includes a first opposite surface, a second opposite surface; and a third opposite surface, and while the second engagement portion is engaged with the first engagement portion, the first contact surface contacts the first opposite surface, the second contact surface contacts the second opposite surface, and the third contact surface contacts the third opposite surface, so that, while the handle cover is assembled to the handle main body, a position of the handle cover relative to the handle main body is regulated.

13. The vehicle door handle according to claim 12, wherein the handle main body includes an accommodation portion accommodating an electronic part, the accommodation portion being covered by the handle cover.

14. The vehicle door handle according to claim 12, wherein the handle main body possesses spaced apart side walls which are each covered by a respective side wall of the handle cover.

15. The vehicle door handle according to claim 12, wherein the vehicle door handle comprised of both the handle main body and the handle cover is configured to be gripped by a person when the vehicle door is opened.

* * * * *